US005880748A

United States Patent [19]

Childers et al.

[11] Patent Number: 5,880,748

[45] Date of Patent: Mar. 9, 1999

[54] INK DELIVERY SYSTEM FOR AN INKJET PEN HAVING AN AUTOMATIC PRESSURE REGULATION SYSTEM

[75] Inventors: Winthrop D. Childers, San Diego; Brian J. Keefe, La Jolla, both of Calif.; John Paul Harmon, Albany, Oreg.

[73] Assignee: Hewlett-Packard Company, Palo Alto, Calif.

[21] Appl. No.: 705,394

[22] Filed: Aug. 30, 1996

Related U.S. Application Data

[63] Continuation-in-part of Ser. No. 309,302, Sep. 20, 1994, abandoned.

[51] Int. Cl.[6] ..... B41J 2/175; B41J 2/11

[52] U.S. Cl. ..... 347/6; 347/85

[58] Field of Search ..... 347/6, 85

[56] References Cited

U.S. PATENT DOCUMENTS

| | | |
|---|---|---|
| 3,169,821 | 2/1965 | Miller . |
| 3,335,424 | 8/1967 | Hartai . |
| 3,656,660 | 4/1972 | Mueller . |
| 4,074,284 | 2/1978 | Dexter et al. . |
| 4,183,031 | 1/1980 | Kyser et al. . |
| 4,342,042 | 7/1982 | Cruz-Uribe et al. . |
| 4,420,100 | 12/1983 | Mueller . |
| 4,422,084 | 12/1983 | Saito . |
| 4,432,005 | 2/1984 | Duffield et al. . |
| 4,604,633 | 8/1986 | Kimura et al. . |
| 4,636,814 | 1/1987 | Terasawa . |
| 4,639,738 | 1/1987 | Young et al. . |
| 4,700,205 | 10/1987 | Rich et al. . |
| 4,728,004 | 3/1988 | Bonerb . |
| 4,734,711 | 3/1988 | Piatt et al. . |
| 4,977,413 | 12/1990 | Yamanaka et al. . |
| 5,289,211 | 2/1994 | Morandotti et al. . |
| 5,367,328 | 11/1994 | Erickson . |

OTHER PUBLICATIONS

Gottschalk, "Sensing Technology Goes Consumer", Design News, Jan. 20, 1992, pp. 68–74.

*Primary Examiner*—Valerie Lund
*Attorney, Agent, or Firm*—Dennis G. Stenstrom

[57] ABSTRACT

An ink delivery system for an ink jet printing system having a printhead for ejecting droplets of ink, the printhead receiving ink at a controlled pressure, the controlled pressure having a specified pressure range that assures stable printhead operation which includes a replaceable ink supply removeably mounted in an ink supply station, and a controllable valve. The valve inlet is in fluid communication with the replaceable ink supply. An accumulator in fluid communication with the valve outlet and the printhead has a sensor coupled to the accumulator to sense the state of the accumulator. A controller electrically coupled to the sensor and electrically coupled to the controllable valve opens and closes the valve in response to the state of the accumulator.

29 Claims, 8 Drawing Sheets

INK DELIVERY SYSTEM FOR AN INKJET PEN HAVING AN AUTOMATIC PRESSURE REGULATION SYSTEM

CROSS-REFERENCE TO RELATED APPLICATIONS

This application is a continuation-in-part of application U.S. application Ser. No. 08/309,302, filed Sep. 20, 1994, entitled "Closed Loop Servo System for Pen Ink Delivery", now abandoned.

FIELD OF THE INVENTION

The present invention relates generally to thermal inkjet technology, more particularly to ink containment and delivery systems for a pen using an off-board ink reservoir and, more specifically, to a automatic controller system for a pressure regulator used in an ink delivery system for inkjet pen and a method of operation using said system.

BACKGROUND OF THE INVENTION

Thermal inkjet hardcopy devices such as printers, graphics plotters, facsimile machines and copiers have gained wide acceptance. These hardcopy devices are described by W. J. Lloyd and H. T. Taub in "Ink Jet Devices," Chapter 13 of *Output Hardcopy Devices* (Ed. R. C. Durbeck and S. Sherr, San Diego: Academic Press, 1988) and U.S. Pat. Nos. 4,490,728 and 4,313,684. The basics of this technology are further disclosed in various articles in several editions of the *Hewlett-Packard Journal* [Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No.1 (February 1994)], incorporated herein by reference. Inkjet hardcopy devices produce high quality print, are compact and portable, and print quickly and quietly because only ink strikes the paper.

An inkjet printer forms a printed image by printing a pattern of individual dots at particular locations of an array defined for the printing medium. The locations are conveniently visualized as being small dots in a rectilinear array. The locations are sometimes "dot locations", "dot positions", or "pixels". Thus, the printing operation can be viewed as the filling of a pattern of dot locations with dots of ink.

Inkjet hardcopy devices print dots by ejecting very small drops of ink onto the print medium and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

The typical inkjet printhead (i.e., the silicon substrate, structures built on the substrate, and connections to the substrate) uses liquid ink (i.e., dissolved colorants or pigments dispersed in a solvent). It has an array of precisely formed orifices or nozzles attached to a printhead substrate that incorporates an array of ink ejection chambers which receive liquid ink from the ink reservoir. Each chamber is located opposite the nozzle so ink can collect between it and the nozzle. The ejection of ink droplets is typically under the control of a microprocessor, the signals of which are conveyed by electrical traces to the resistor elements. When electric printing pulses heat the inkjet firing chamber resistor, a small portion of the ink next to it vaporizes and ejects a drop of ink from the printhead. Properly arranged nozzles form a dot matrix pattern. Properly sequencing the operation of each nozzle causes characters or images to be printed upon the paper as the printhead moves past the paper.

The ink cartridge containing the nozzles is moved repeatedly across the width of the medium to be printed upon. At each of a designated number of increments of this movement across the medium, each of the nozzles is caused either to eject ink or to refrain from ejecting ink according to the program output of the controlling microprocessor. Each completed movement across the medium can print a swath approximately as wide as the number of nozzles arranged in a column of the ink cartridge multiplied times the distance between nozzle centers. After each such completed movement or swath the medium is moved forward the width of the swath, and the ink cartridge begins the next swath. By proper selection and timing of the signals, the desired print is obtained on the medium.

Color inkjet hardcopy devices commonly employ a plurality of print cartridges, usually either two or four, mounted in the printer carriage to produce a full spectrum of colors. In a printer with four cartridges, each print cartridge contains a different color ink, with the commonly used base colors being cyan, magenta, yellow, and black. In a printer with two cartridges, one cartridge usually contains black ink with the other cartridge being a tri-compartment cartridge containing the base color cyan, magenta and yellow inks. The base colors are produced on the media by depositing a drop of the required color onto a dot location, while secondary or shaded colors are formed by depositing multiple drops of different base color inks onto the same dot location, with the overprinting of two or more base colors producing the secondary colors according to well established optical principles.

An inkjet printhead generally includes: (1) ink channels to supply ink from an ink reservoir to each vaporization chamber proximate to an orifice; (2) a metal orifice plate or a nozzle member in which the orifices are formed in the required pattern; and (3) a silicon substrate containing a series of thin film resistors, one resistor per vaporization chamber.

For many applications, such as personal computer printers and fax machines, the ink reservoir has been incorporated into the pen body such that when the pen runs out of ink, the entire pen, including the printhead, is replaced. See, for example, U.S. Pat. No. 4,500,895 (ink bladder type pen), U.S. Pat. No. 4,746,935 and U.S. Pat. No. 4,771,295 (saturated foam type pen) and U.S. Pat. No. 5,359,353 (spring-bag type pen) all assigned to the assignee of the present invention and incorporated herein by reference.

However, for other hardcopy applications, such as large format plotting of engineering drawings, color posters and the like, there is a requirement for the use of much larger volumes of ink than can be contained within the replaceable pens. Therefore, various off-board ink reservoir systems have been developed recently. As examples, see U.S. Pat. No. 4,831,389 which shows a multicolor off-board ink supply system; U.S. Pat. No. 4,929,963 which demonstrates an ink delivery system for an inkjet printer using a low pressure recirculating pumping system; and U.S. Pat. No. 4,968,998, which teaches an inkjet pen which is refillable at a service station on-board the hardcopy machine all of the above are assigned to the assignee of the present invention and incorporated herein by reference.

A problem common to such off-board ink supply systems is pressure regulation of the ink at the printhead. Too much pressure can result in the undesirable "drooling" of ink from the printhead nozzles. Therefore, inkjet pens are generally operated at a slight back or negative gauge pressure. However, too much back pressure can result in the printhead being starved of ink and deprimed. If the pen is deprimed, there will likely be misfiring of the nozzles which results in poor print quality. Moreover, too much back pressure can also cause air to be sucked into the pen when not in operation, causing air bubble entrapment which can lead to printing problems. Thus, while it is generally preferable to maintain a slight back pressure in the pen, a back pressure which is too large can adversely affect printing operations.

Accordingly, there is a need for an ink delivery system that improves pressure regulation for thermal inkjet pens using an off-board ink reservoir.

SUMMARY OF THE INVENTION

The present invention is an ink delivery system for an ink jet printing system having a printhead for ejecting droplets of ink, the printhead receiving ink at a controlled pressure, the controlled pressure having a specified pressure range that assures stable printhead operation, including a replaceable ink supply removeably mounted in an ink supply station; a controllable valve having a valve inlet and a valve outlet, the valve inlet in fluid communication with the replaceable ink supply; an accumulator in fluid communication with the valve outlet and the printhead; a sensor coupled to the accumulator to sense the state of the accumulator; and a controller electrically coupled to the sensor and electrically coupled to the controllable valve to open and close the valve in response to the state of the accumulator.

It is an advantage of the present invention that it it provides a method to deliver ink from a remote ink supply to a printhead with reliability and flexibility and that ink flow may be completely shut off, facilitating replacement of pen mechanisms..

It is another advantage of the present invention that it solves the problem of carriage acceleration induced pressure surge effects by providing capacitance at the printhead and controller and also allows the system to detect an out of ink condition.

It is further advantage of the present invention that it can be reprogrammed during real-time operation.

It is a still further advantage of the present invention that it provides an easily manufacturable system using long-life, solid state components and allows for adjustments to manufacturing design tolerance variations.

It is yet another advantage of the present invention that the priming of a pen can be accomplished without building special purpose hardware components into the hardcopy apparatus.

Other features and advantages of the present invention will become apparent upon consideration of the following detailed description and the accompanying drawings.

The drawings referred to in this description should be understood as not being drawn to scale except if specifically noted.

DETAILED DESCRIPTION OF THE INVENTION

Reference is made now in detail to a specific embodiments of the present invention, which illustrates the best mode presently contemplated by the inventors for practicing the invention. Alternative embodiments are also briefly described as applicable. While the invention is described in terms of an exemplary embodiment in an inkjet pen, it will be recognized by a person skilled in the art that the system is readily adaptable to other remote ink supply refillable pens. No intentional limitation is intended by the exemplary embodiments nor should any be implied.

Figure 1:
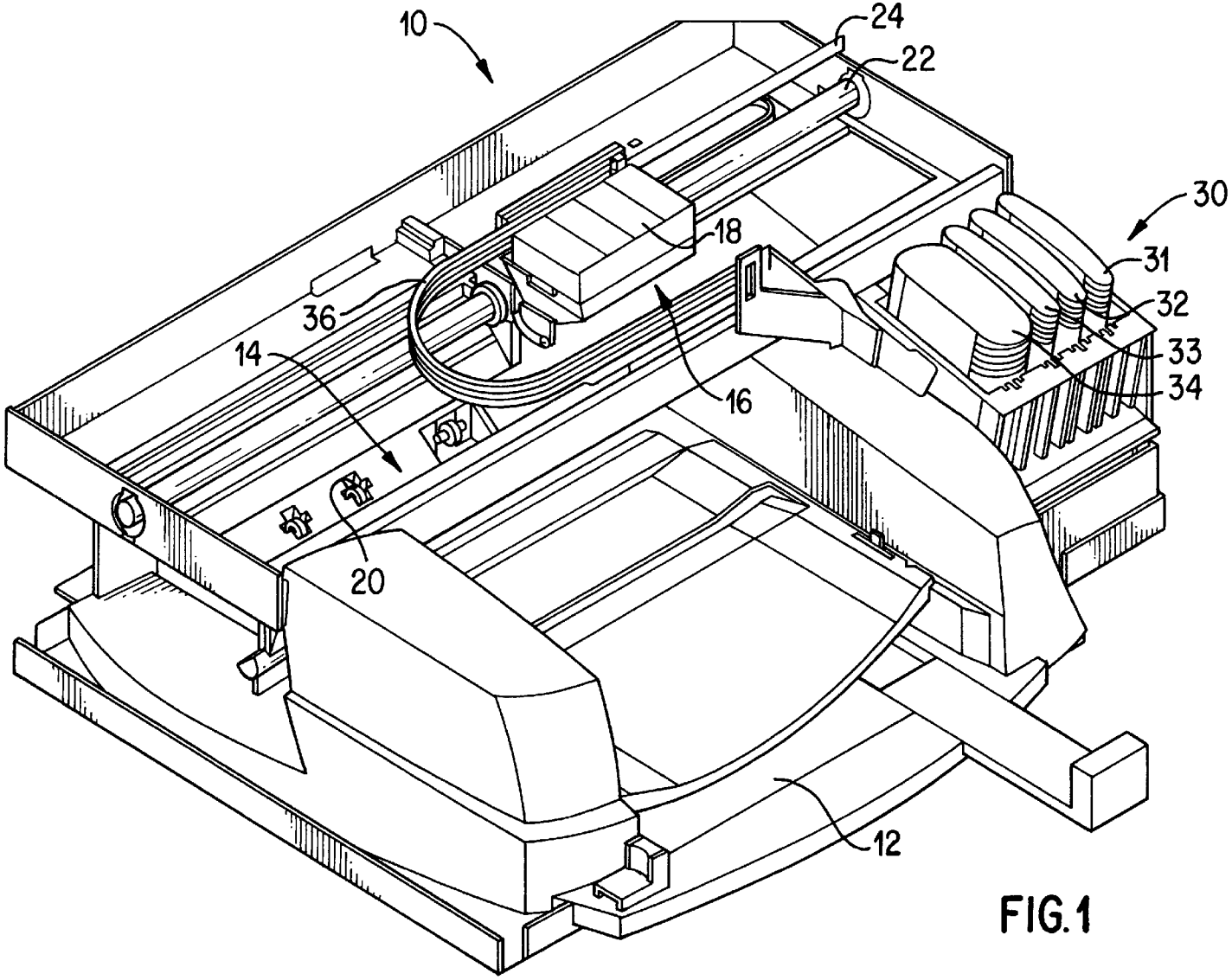
FIG. 1 is a perspective view of first embodiment of an inkjet printer incorporating the present invention.

FIG. 1 is a perspective view of one embodiment of an inkjet printer 10, with its cover removed. Generally, printer 10 includes a tray 12 for holding virgin paper. When a printing operation is initiated, a sheet of paper from tray 12 is fed into printer 10 using a sheet feeder, then brought around in a U direction to now travel in the opposite direction toward tray 12. The sheet is stopped in a print zone 14, and a scanning carriage assembly 16, containing one or more print cartridges 18, is then scanned across the sheet for printing a swath of ink thereon.

After a single scan or multiple scans, the sheet is then incrementally shifted using a conventional stepper motor and feed rollers 20 to a next position within print zone 14, and carriage 16 again scans across the sheet for printing a next swath of ink. When the printing on the sheet is complete, the sheet is forwarded to a position above tray 12, held in that position to ensure the ink is dry, and then released.

Alternative embodiment printers include those with an output tray located at the back of printer 10, where the sheet of paper is fed through the print zone 14 without being fed back in a U direction.

The carriage 16 scanning mechanism may be conventional and generally includes a slide rod 22, along which carriage 16 slides, and a coded strip 24 which is optically detected by a photodetector in carriage 16 for precisely positioning carriage 16. A stepper motor (not shown), connected to carriage 16 using a conventional drive belt and pulley arrangement, is used for transporting carriage 16 across print zone 14.

The novel features of inkjet printer 10 and the other inkjet printers described in this specification relate to the ink delivery system for providing ink to the print cartridges or pens 18 and ultimately to the ink ejection chambers in the printheads. This ink delivery system includes an off-axis, or off-board, ink supply station 30 containing replaceable ink supply cartridges 31, 32, 33, and 34, which may be pressurized or at atmospheric pressure. For color printers, there will typically be a separate ink supply cartridge for black ink, yellow ink, magenta ink, and cyan ink. In the printer 10 shown in FIG. 1, the pressure regulation is integral to the print cartridges or pens 18.

Four tubes 36 carry ink from the four replaceable ink supply cartridges 31–34 to the four print cartridges 18.

Various embodiments of the off-axis ink supply, scanning carriage, and print cartridges will be described herein.

Figure 2:
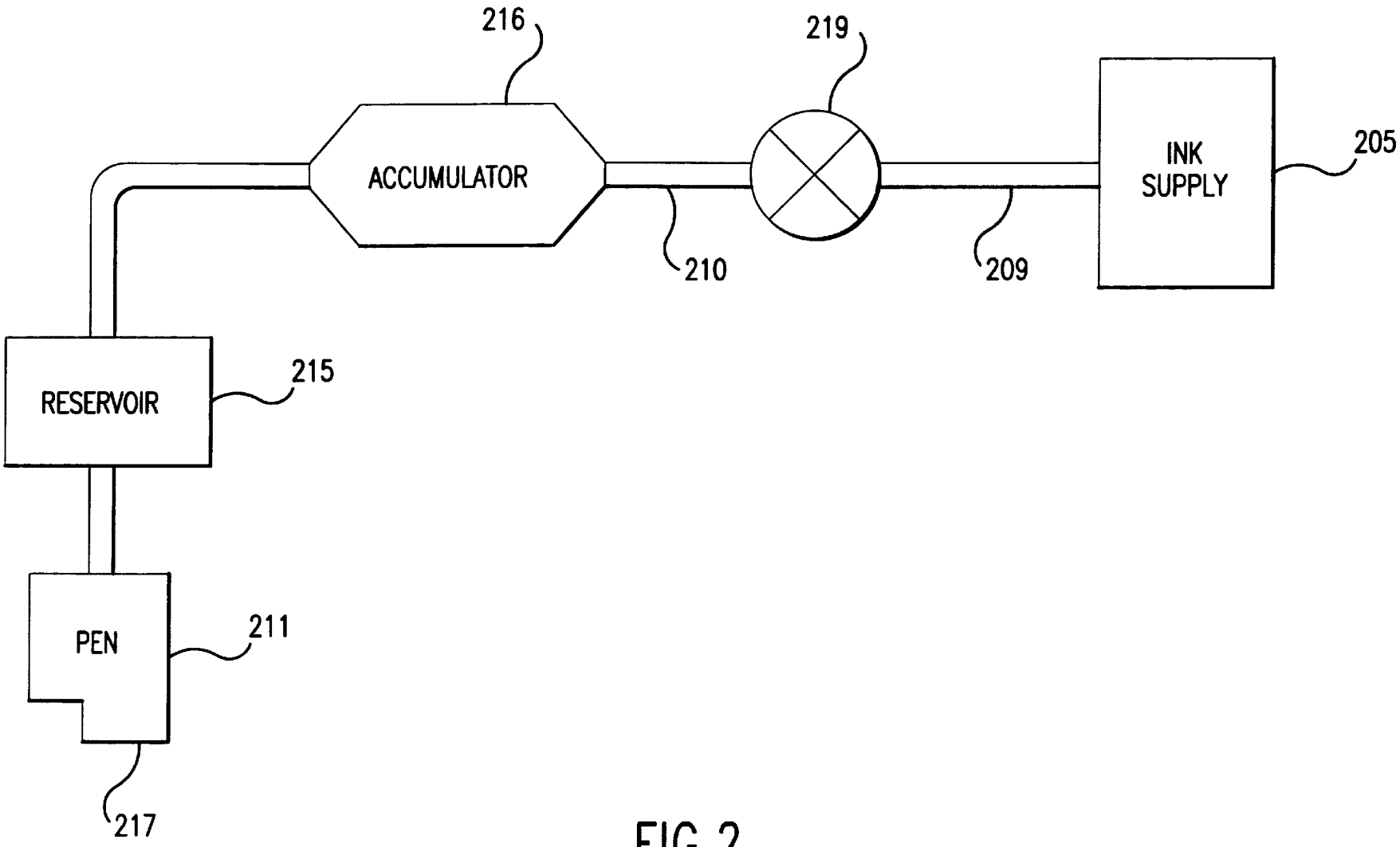
FIG. 2 is a schematic representation of a generic embodiment of the present invention.

A generic schematic of the present invention is shown in FIG. 2. A printhead 217 is mechanically coupled to a scanning print cartridge or pen 211. The printhead 217 is fluidically coupled to the reservoir 215 either integrally or by a fluid conduit 212, the reservoir 215 is fluidically coupled to a compliant member or accumulator 216. The accumulator 216 is in fluidic communication with the reservoir 215 on a first surface and with ambient air on a second surface. When accumulator 216 is integral to the reservoir 215, as the printhead 217 ejects ink, the accumulator 216 collapses into the reservoir 215. The compliance produces back pressure in the reservoir 215, which increases as the accumulator 216 collapses. The compliance can be provided by a spring bag, a rubber bladder or a diaphragm design without departing from the scope of this overall concept. See, for example, U.S. Pat. No. 4,500,895 (ink bladder type pen and U.S. Pat. No. 5,359,353 (spring-bag type pen) all assigned to the assignee of the present invention and incorporated herein by reference. The reservoir 215 is also fluidically coupled by a fluid conduit 210 to the outlet of a controllable valve mechanism 219 which opens and closes in response to back pressure in the reservoir 215. Such controllable valve mechanisms 219 are commercially available and selection of a particular design for a specific implementation would be within the purview of a person skilled in the art. Controllable valve mechanism 219 can be a peristaltic valve ("pinch valve"), a solenoid valve, or any other valve that can be actuated automatically. While the present invention is exemplified in an embodiment where the controllable valve mechanism 219 is used in an open/on or closed/off manner, it will be obvious to a person skilled in the art that more costly valve mechanisms with variable flow control can be substituted for the controllable valve mechanism 219. The inlet of valve 219 is fluidically coupled to a fluid conduit 209 that is fluidically coupled to an ink supply 205. When the backpressure in the reservoir 215 reaches a first critical value, the valve 219 opens, fluidically connecting the reservoir 215 and the ink supply 205. Ink flows into the reservoir 215, reducing the backpressure and allowing the accumulator 216 to relax. When the backpressure becomes less than a second critical value, the valve closes. In this way, the valve 219 and accumulator 216 act as an active pressure regulation mechanism. Valve 219 and accumulator 216, individually, may be either onboard the printer carriage 16 or off-board the printer carriage. Off-board is also referred to as off-axis, i.e., off the axis of the printer's carriage assembly 16 which holds the print cartridges 18. When valve 219 and accumulator 216 are on-board they may be individually either integral to the print cartridge 18 or separate on the carriage 16 and fluidically connected. The reservoir 215 is maintained at a pressure that varies within the operational limits of the printhead 217, regardless of the inlet pressure to the regulator valve 219. Reservoir 215 is always on-board the print carriage 16 and in most situations integral with the print cartridge 18. Reservoir 215 and accumulator 216 may also be either integral to each or separate and fluidically connected.

For high throughput printing, the ink supply 205 can be pressurized. For lower throughput printing, the ink supply 205 can be a flaccid or unpressurized bag. Regardless of inlet pressure to the valve 219, the valve 219 and accumulator 216 act to maintain the printhead gauge pressure in the 0 to −11.0 inches $H_2O$ range for current printhead designs, with a preferred range in the −3.0 to −6.0 inches $H_2O$ range. Gauge pressure is defmed as absolute pressure minus atmospheric pressure.

Figure 3:
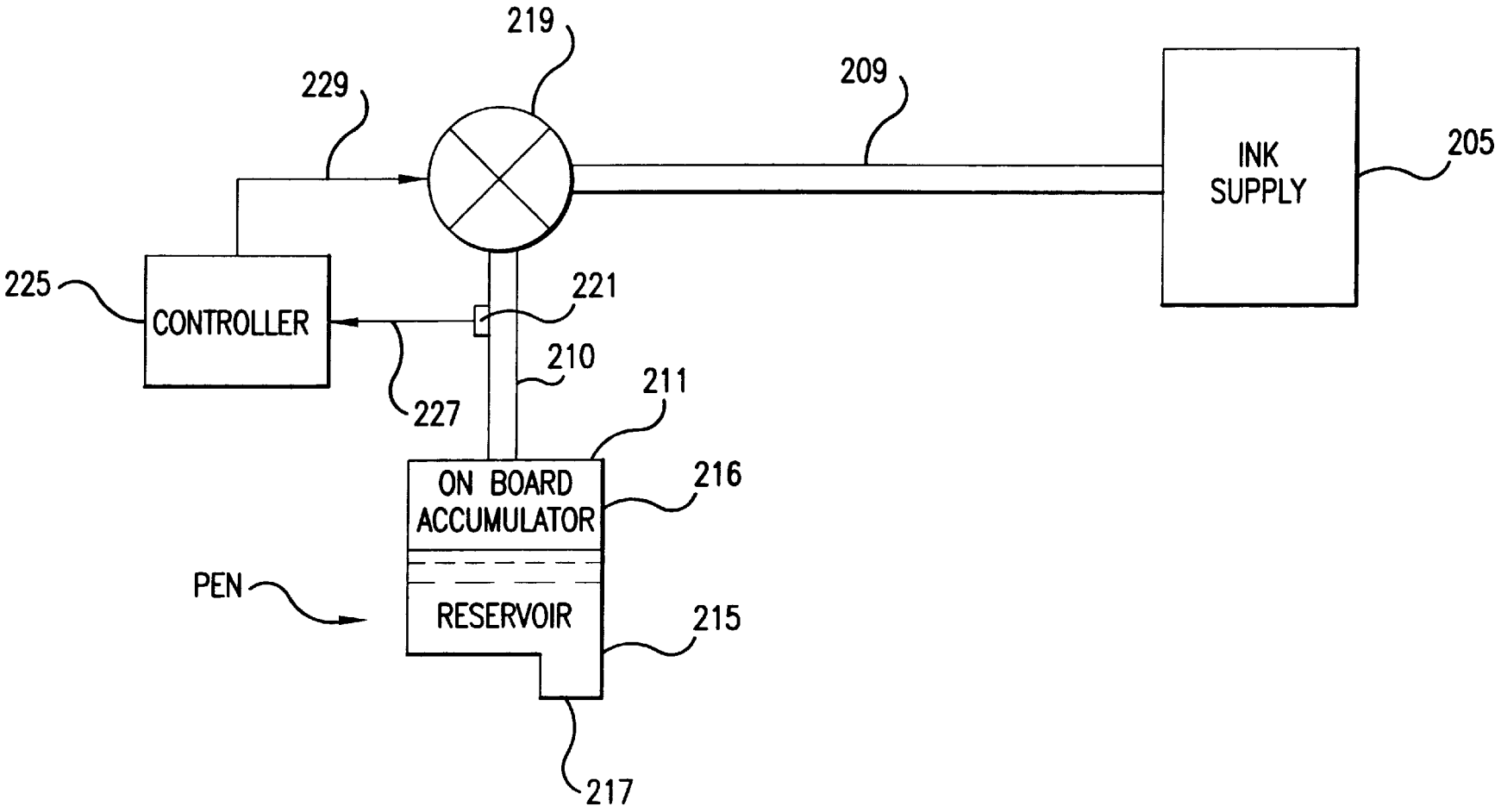
FIG. 3 is a schematic representation of an embodiment of the present invention using an on-board regulator.

Shown in FIG. 3 is an embodiment of the present invention which has active pressure regulation integral to the print cartridge or pen 211. The reservoir 215 and accumulator 216 are fully contained on the print cartridge 211. The controllable valve 219 can be on the cartridge 211 or upstream from the cartridge 211 and connected by a fluid conduit 210. A pressure sensor 221 located between the valve 219 and the printhead reservoir 215 senses the gauge pressure. When the gauge pressure exceeds a certain value, i.e., a larger subatmospheric pressure or more negative gauge pressure, the sensor 221 ends a signal to a valve controller circuit 225 that opens the controllable valve 219. When the controllable valve 219 is properly triggered to open by the controller circuit 225, it remains open until the proper amount of ink has flowed into the reservoir 215. During this refill, the pressure sensor 221 will see the pressure of the ink supply. Thus, the pressure sensor 221 cannot be used for feedback to the controller circuit 225 during the ink refill stage.

There should be a "debounce time", or a minimum time of large gauge pressure, to trigger the controller circuit 225 and thus controllable valve 219. Otherwise, short large back pressure spikes due to printer carriage motion could erroneously trigger the controller circuit 225. The minimum debounce time for back pressure regulation is set by the particular printer's total acceleration time between printer carriage traverses across the media. For example, a debounce time of two seconds has been found optimal for the carriage accelerations associated with the Hewlett-Packard Deskjet 850C. The "debounce time" functionality can be implemented as an analog circuit or a digital control system. For a normally closed switch-type pressure sensor, the analog circuit has a low pass filter section into a Schmidt trigger that triggers a timer for the controller circuit 225.

There are two ways of sensing pressure or fill state in the accumulator: (1) sensing the position of the accumulator, and (2) sensing the pressure within the accumulator. Sensing the position of the accumulator is a direct method for sensing the fill state of the accumulator and an indirect method for detecting the pressure in the accumulator. Sensing the pressure within the accumulator is a direct method for detecting the pressure in the accumulator and an indirect method for sensing the fill state of the accumulator. Direct and indirect accumulator sensing methods could be used for an accumulator that scans with the printhead. For example, a pressure sensor could be integral to a spring bag accumulator or alternatively, a leaf spring could be integral to a spring bag accumulator. It is best to have the pressure sensor is located as close to the printhead as possible. However the pressure sensor may be located any where upstream after the regulator valve by adjusting for the pressure drop to the printhead and calibrating the control system appropriately.

To sense the position of the accumulator, several alternatives exist. First, a leaf spring which opens and closes a circuit as the accumulator collapses and expands can be mounted on the accumulator. If the accumulator is spring bag based, then a two contact leaf spring devise can be used. The controller circuit 225 is connected to the two contacts. When the contacts are electrically connected, the spring bag is relatively full, and the valve is closed. When the spring bag becomes empty, the leaf spring loses contact, triggering the valve to open. Such a leaf spring device is described in the copending U.S. application Ser. No. 08/538,685, filed Oct. 2, 1995, entitled Spring Bag Based, Off Axis Ink Delivery System and Pump Trigger, which is herein incorporated by reference.

Second, an optical emitter/detector pair can be aligned across the side of the accumulator such that the beam is broken as the accumulator expands, and unbroken when the accumulator collapses past a critical point. Such a method and apparatus for sensing and controlling pressure using optical detection of the location of a spring bag within the print cartridge is described in U.S. application Ser. No. 08/545,964, filed Oct. 25, 1995, entitled Ink Volume Sensing and Replenishing System and in U.S. application Ser. No. 08/546,387 filed Oct. 25, 1995, entitled Ink Volume Indicating Ink Reservoir Cartridge System which are herein incorporated by reference. The method and apparatus described therein is also applicable to a spring bag accumulator.

Other position sensing means include inductive sense, capacitive sense, and Hall effect sense of accumulator position.

To sense the pressure within the accumulator involves placing a pressure sensor in fluid communication with the accumulator, several alternatives exist for doing this. First, a pressure sensor can be placed in fluid communication with the printhead between the regulator valve 219 and accumulator 216. This would allow for very precise pressure regulation. Pressure sensing mechanisms such as pressure transducers are well-known and commercially available; selection of a particular design for a specific implementation would be within the purview of a person skilled in the art.

Second, an electromechanical pressure switch can be used, whereby a diaphragm is placed in fluid communication with the printhead between the regulator valve 219 and printhead 217. The diaphragm moves in response to gauge pressure mechanically opening and closing a switch. This concept is illustrated in U.S. application Ser. No. 08/538,685, filed Oct. 2, 1995, entitled Spring Bag Based, Off Axis Ink Delivery System and Pump Trigger which is herein incorporated by reference.

In general, a hardcopy apparatus has an electronic controller board 225. Such controller boards 225 are usually equipped with a microprocessor (not shown) capable of handling both the host computer interface and various hardcopy apparatus engine functions such as pen control, media transport, and the like. In accordance with the present invention, the microprocessor, or an application specific integrated circuit ("ASIC"), is employed to control the ink flow and pressure level. A signal indicative of a sensed pressure from the sensor 221 can be compared to programmed pressure set point levels and used as a control device to activate the controllable valve mechanism 219 appropriately. Electrical leads 227, 229, connect the controller board 225 to the pressure sensor 221 and controllable valve 219 in accordance with their design specifications. The above pressure sensing system can also be used to detect an out of ink situation in the ink supply 205. If opening the controllable valve 219 does not restore the backpressure to its normal range, then it can be inferred that the ink supply 205 is out of ink. Thus, there is a separate debounce time for out of ink detect, whereby the minimum debounce time is equal to the refill time. The printer will then inform the user that it is time to replace the replaceable ink supply 205.

Figure 4:
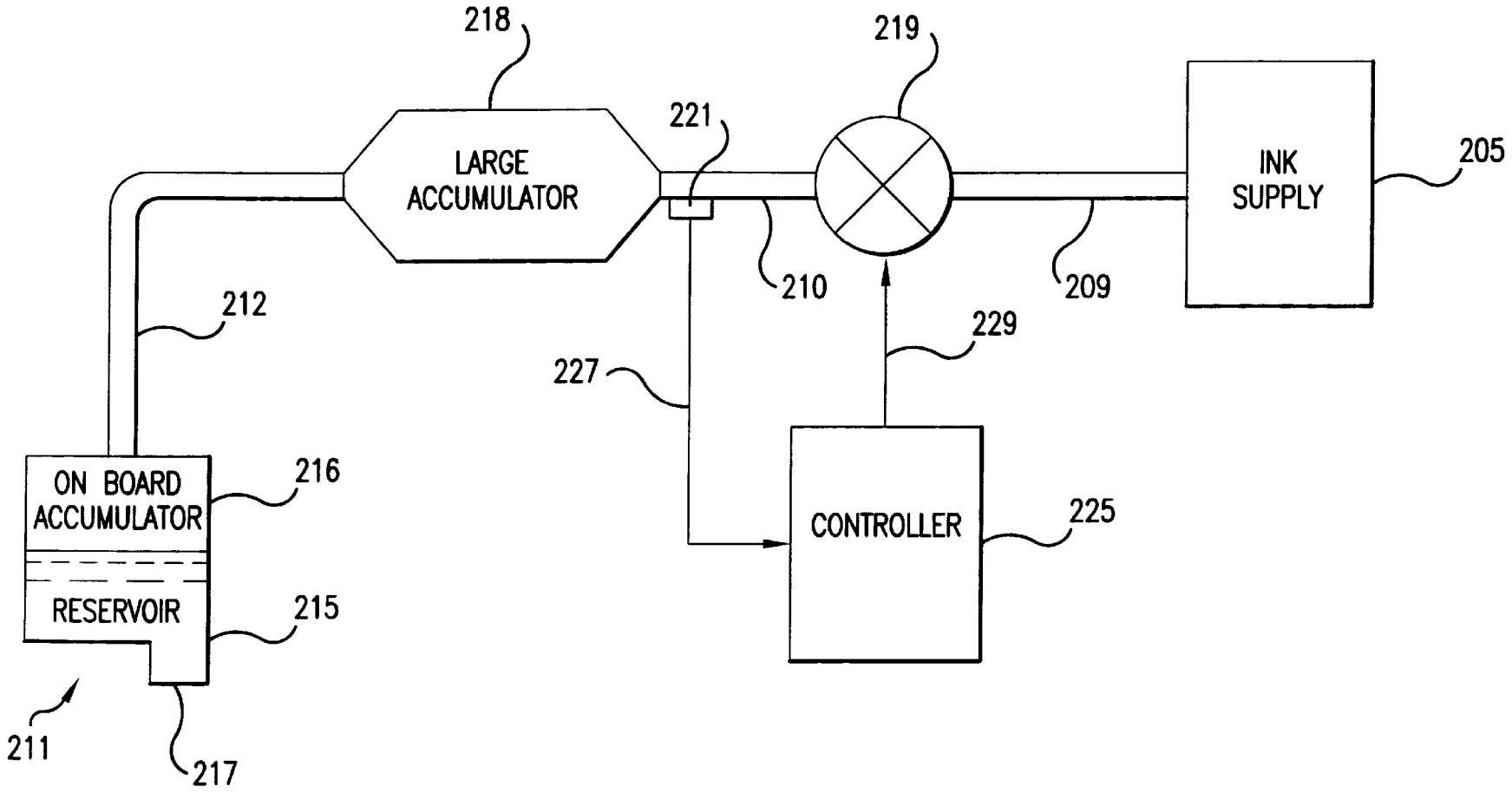
FIG. 4 is a schematic representation of an embodiment of the present invention using an off-board regulator.

Shown in FIG. 4 is an off-board embodiment of the present invention. The pressure sensor 221 can be located anywhere downstream of the regulator valve 219, i.e., between the regulator valve 219 and the printhead 217. A small accumulator is located in the print cartridge 211 or on-board the printer carriage very close to the print cartridge 211. This is useful to eliminate carriage acceleration induced pressure spikes. These spikes occur due to the inertial pumping caused by the acceleration of ink in the conduit due to printer carriage motion. Without such an accumulator, the printhead 217 operation would be intermittent. Such an accumulator can be a very small diaphragm separating the printhead reservoir 215 and ambient air, or any other compliant design. This will minimize the print cartridge 211 size and hence printer size. The larger accumulator 218 can accommodate more air in the system without drooling. In this embodiment compliance or accumulation is preferably provided by a spring bag, although it could also be provided by a bladder, a diaphragm or any other means of providing compliance. Sensing pressure and providing out of ink detect can be done by the same methods as described for the on-board embodiment above.

Figure 5:
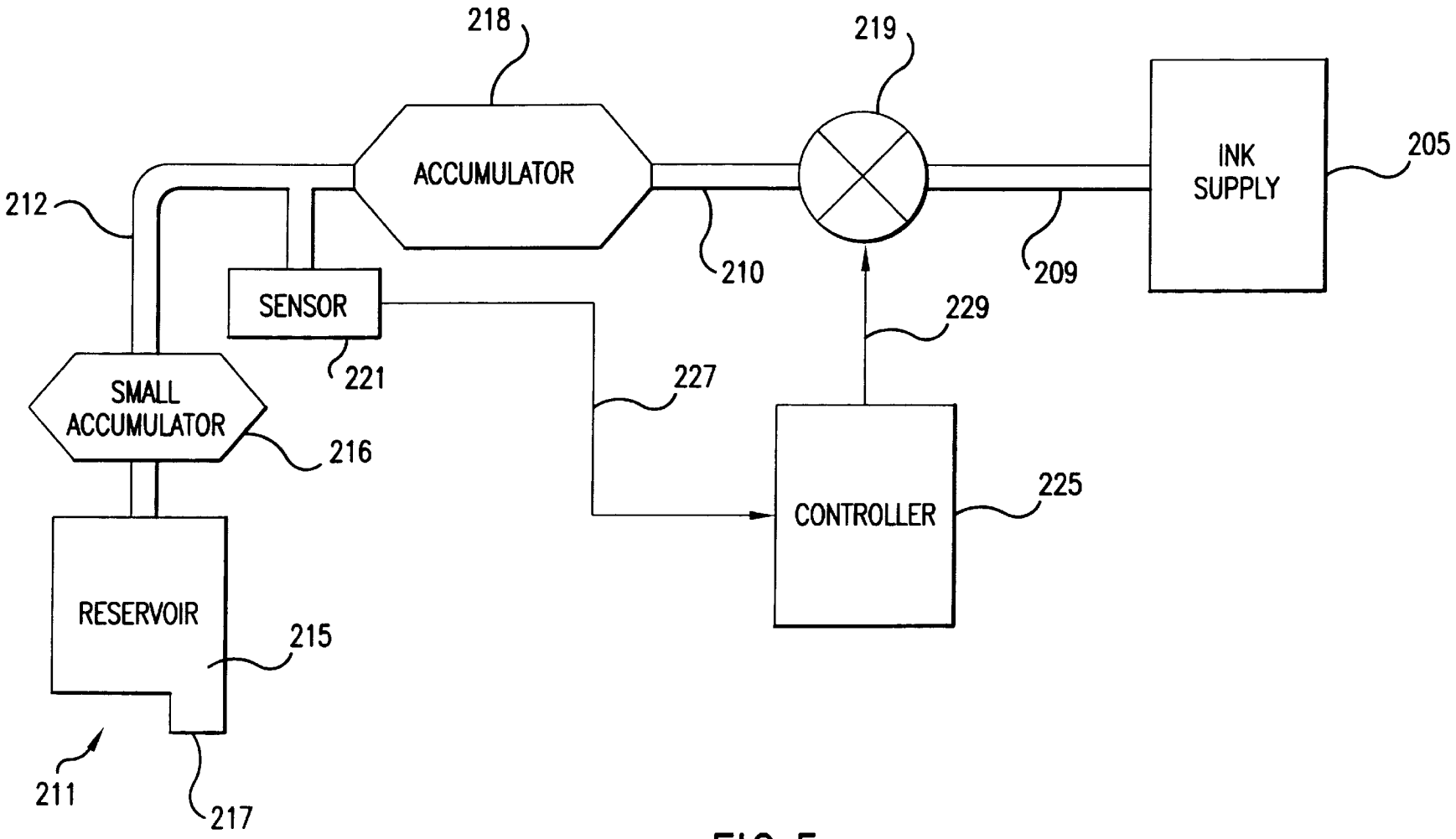
FIG. 5 is a schematic representation of an embodiment of the present invention which detects the fill state by sensing the pressure of ink in the accumulator.
Figure 6:
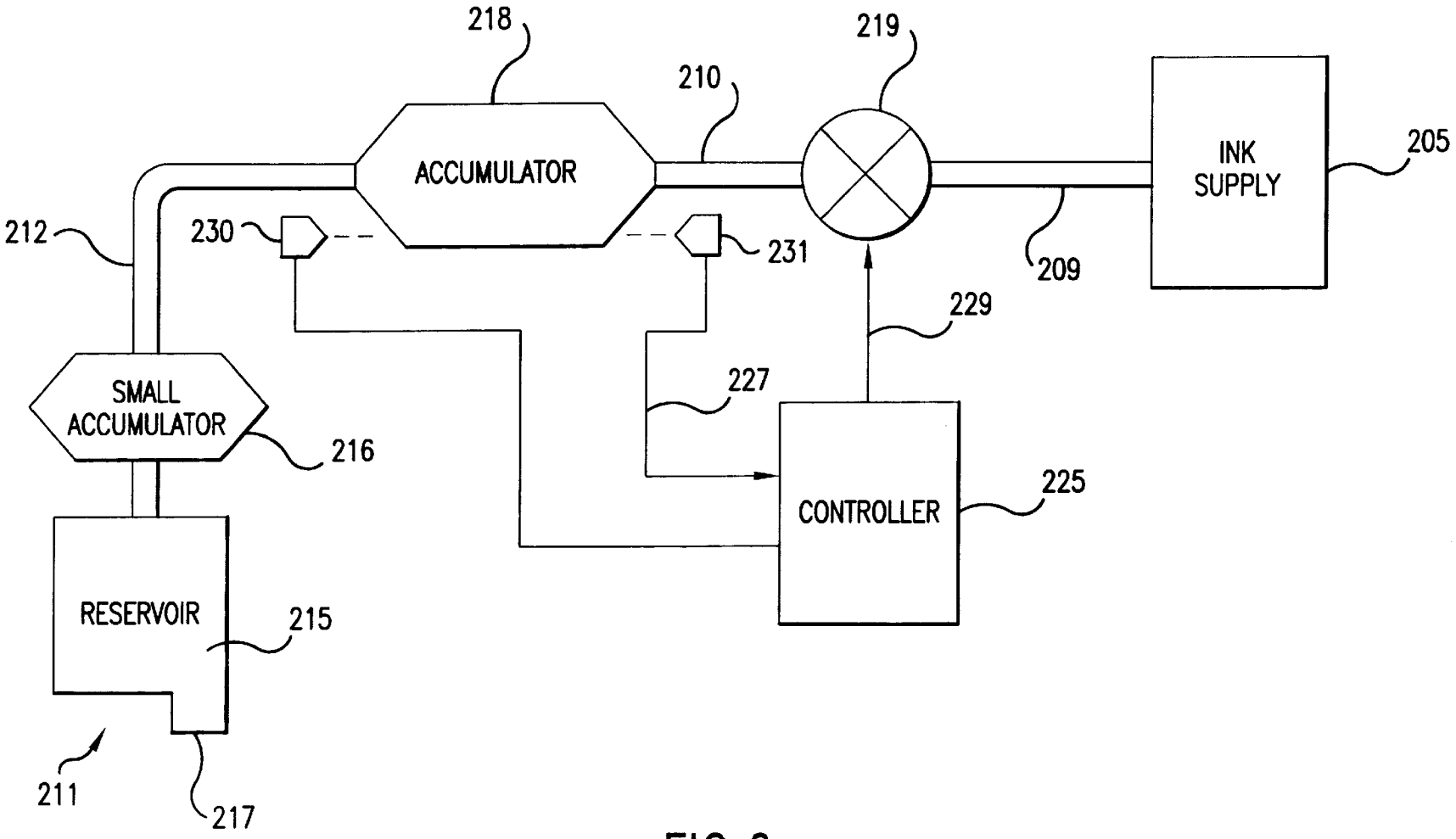
FIG. 6 is a schematic representation of an embodiment of the present invention which detects the fill state by sensing the position of the wall of the accumulator using an emitter/detector pair.

FIGS. 5 and 6 show two additional embodiments of the present invention. Shown is a small accumulator 216 that scans with the printhead 211 and a separate larger accumulator 218. If the large accumulator 218 is integral to the printhead 211, then the small accumulator 216 is not necessary. The primary difference between FIGS. 5 and 6 is the way the fill state or pressure of either the large and small accumulator is detected. FIG. 5 shows the indirect method of detecting the fill state by sensing the pressure of ink in the accumulator 218. FIG. 6 shows the direct way of detecting the fill state by sensing the position of a inside wall of the accumulator 218 using an emitter/detector photo diode pair 230, 231 concept as described above.

Figure 7:
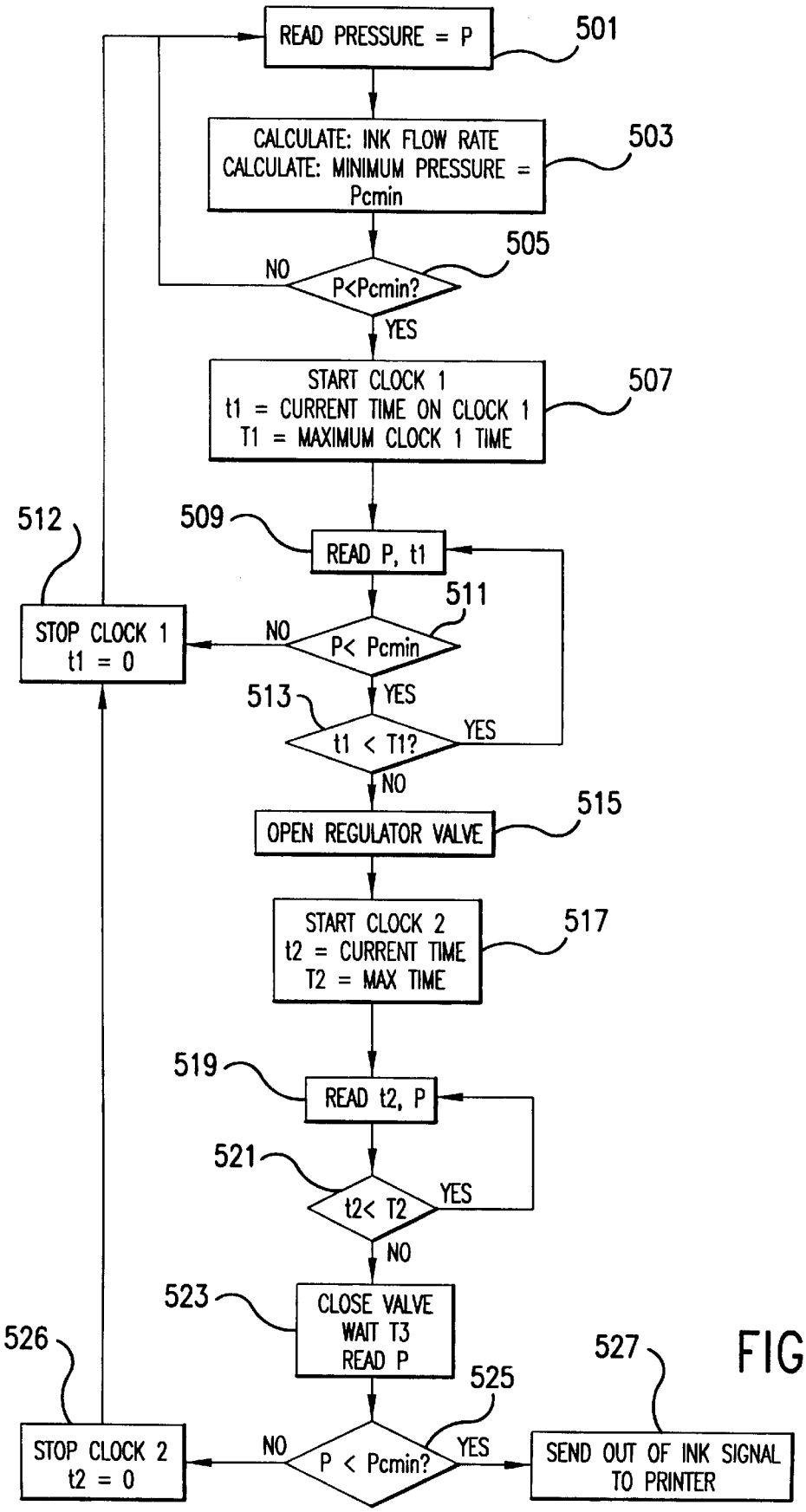
FIG. 7 is a flow chart depicting a first embodiment of a control routine for the present invention as shown in FIGS. 2 to 6.
Figure 8:
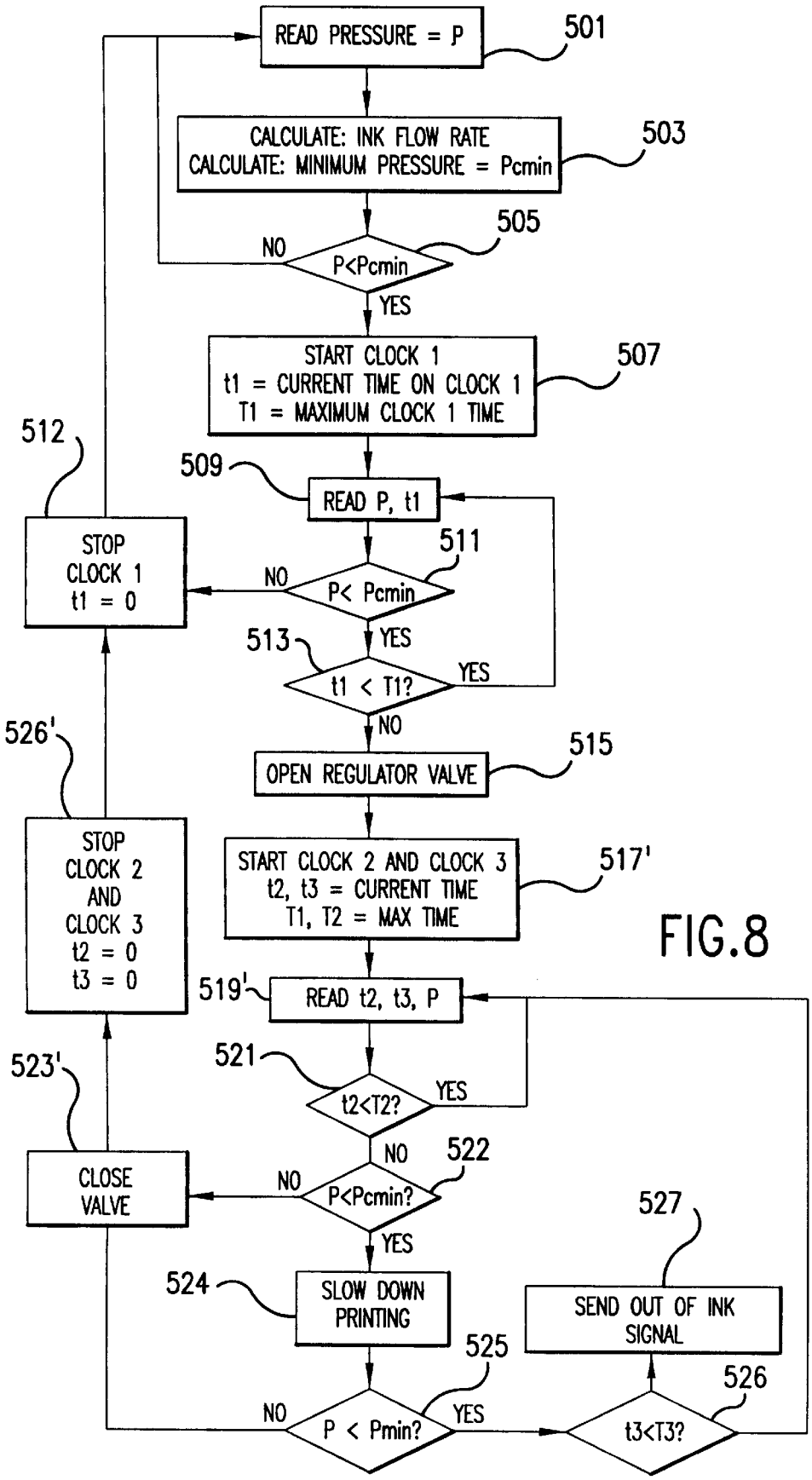
FIG. 8 is a flow chart depicting a second embodiment of a control routine for the present invention as shown in FIGS. 2 to 6.

Exemplary pressure control routines in accordance with the present invention are shown in FIGS. 7 and 8. The pressure sensor 221 monitors the fluid pressure as described above. Referring to FIG. 7, shown is a pressure control routine which is executed continuously during printing. $P_{cmin}$ is the minimum acceptable gauge pressure at the current print rate or ink flow rate. In step 501, the pressure, p, from pressure sensor 221 is read. In step 503 the minimum gauge pressure at the current printing speed, $P_{cmin}$ is stored in the printer driver or memory for the current ink flow rate or printing speed. In step 505 p is compared with $P_{cmin}$, if p is greater than $P_{cmin}$ the routine returns to step 501, if p is less than $P_{cmin}$ the routine proceeds to step 507 where a first clock is started and T1 is set to a constant preset value based on the "debounce time" of the printer as discussed above. In step 509 the current pressure p and the current time t1 on clock 1 are read. In step 511, p is compared with $P_{cmin}$, if p is greater than $P_{cmin}$ the routine transfers to step 512 where clock 1 is reset to zero and then returns to step 501. If p is less than $P_{cmin}$ the routine proceeds to step 513 where t1 is compared with T1. If t1 is less than T1, the routine returns to step 509, if t1 is greater than T1, the routine proceeds to step 515 where the regulator valve is opened and the routine proceeds to step 517 where clock 2 is started and T2 is set to a preset time for the regulator valve to remain open. In step 519, the current pressure p and current time t2 on clock 2 are read. In step 521, current time t2 is compared with the valve open time T2. If t2 is less than T2, the routine returns to step 519. If t2 is greater than T2, the routine proceeds to step 523 where the regulator valve is closed and the routine waits for a preset time T3 before again reading the current pressure p. T3 is the time required for the pressure to stabilize after closing the valve. In step 525, p is compared with $P_{cmin}$. If p is greater than $P_{cmin}$ the routine transfer to step 512 where clock 2 is reset to zero, then proceeds to step 512 where clock 1 is reset to zero and then the routine returns to step 501. If p is less than $P_{cmin}$ the routine proceeds to step 527 where an out of ink signal is sent to the printer.

Referring to FIG. 8, shown is a pressure control routine with the added feature of printer slow down when the gauge pressure is too high. The routine shown in FIG. 8 is the same as that in FIG. 7 through step 515. $P_{min}$ is the minimum acceptable gauge pressure at any print rate or ink flow rate. $P_{cmin}$ is the minimum acceptable gauge pressure at the current print rate or ink flow rate. Step 517' is the same as 517 except that a third clock 3 is started. In step 519' current times t2 and t3 and current pressure p are read. In step 521, current time t2 is compared with the valve open time T2. If t2 is less than T2, the routine returns to step 519. If t2 is greater than T2, the routine proceeds to step 522 where p is compared with $P_{cmin}$. If p is greater than $P_{cmin}$ the routine goes to step 523' where the regulator valve is closed, then to step 526' where clocks 2 and 3 are reset, then to step 512 where clock 1 is reset and then gauge to step 501. If p is less than $P_{cmin}$ the routine goes to step 524 and the printing is slowed down. In step 525, p is compared with $P_{min}$. If p is greater than $P_{min}$ the routine goes to step 523' and proceeds as described above. If p is less than $P_{min}$ the routine proceeds to step 526 where t3 is compared with T3. If t3 is less than T3, the routine goes back to step 519'. If t3 is greater than T3, the routine goes step 527 where an out of ink signal is sent to the printer.

Note that other pen control and maintenance functions can be similarly programmed into the microprocessor or ASIC. For printhead replacement, where it is important not to contaminate the system by an uncontrolled flow from the ink supply, the pressure set point might be set at −1.0 psi, or any other value appropriate to the particular pen employed. For contending with a deprimed pen, to flush the nozzles and prime the pen, a set point of 1.0 psi may be appropriate.

Generally, a lookup table can be used to store appropriate set point values for each of the tasks requiring a particular fluid pressure at the pen. Moreover, pressure set points can be changed to tailor the system to the design tolerance variations of a particular pen rather than to the mechanical limitations of the system. That is, if a lookup table is provided in a programmable memory, the set point values can be adjusted to reconfigure the system appropriate to real time operations. For example, after fitting an inkjet pen with a printhead to a printer, the printer can try different gauge pressure set points and choose the one which provides the optimal drop volume, drop velocity, and other functional parameters.

Thus, the present invention provides a mechanism and method to deliver ink to a pen printhead from an ink reservoir with both reliability and flexibility.

The foregoing description of the preferred embodiment of the present invention has been presented for purposes of illustration and description. It is not intended to be exhaustive or to limit the invention to the precise form disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application to thereby enable others skilled in the art to understand the invention for various embodiments and with various modifications as are suited to the particular use contemplated. It is intended that the scope of the invention be defined by the claims appended hereto and their equivalents.

What is claimed is:

1. An ink delivery system for an ink jet printing system, having a printhead for ejecting droplets of ink, the printhead receiving ink at a controlled pressure, the controlled pressure having a specified pressure range that assures stable printhead operation, comprising:

a scanning carriage having the printhead mounted thereon, the printhead ejecting droplets of ink as the scanning carriage scans across an ink receiving media;

a replaceable ink supply removeably mounted in an ink supply station;

a controllable valve having a valve inlet and a valve outlet, the valve inlet is in fluid communication with the replaceable ink supply;

an accumulator in fluid communication with the valve outlet and the printhead;

a sensor coupled to the accumulator to sense the pressure within the accumulator; and a controller electrically coupled to the sensor and electrically coupled to the controllable valve to open and close the valve in response to the pressure within the accumulator;

the controller having a threshold pressure set point and a debounce time so that the controllable valve is opened only when the ink pressure remains below the threshold pressure set point for a time exceeding the debounce time.

2. The ink delivery system of claim 1, wherein the sensor is mechanically coupled to the accumulator to sense the volume of the accumulator.

3. The ink delivery system of claim 1, wherein the sensor is fluidically coupled to the accumulator and the printhead to provide a reading indicative of the pressure at the printhead.

4. The ink delivery system of claim 3, wherein the sensor is adjacent to the printhead to sense the pressure of the printhead.

5. The ink delivery system of claim 3, wherein the sensor is adjacent to the accumulator to sense the pressure of the accumulator.

6. An ink delivery system for an ink jet printing system, having a printhead for ejecting droplets of ink, the printhead receiving ink at a controlled pressure, the controlled pressure having a specified pressure range that assures stable printhead operation, comprising:

a scanning carriage having the printhead mounted thereon, the printhead ejecting droplets of ink as the scanning carriage scans across an ink receiving media;

a replaceable ink supply removeably mounted in an ink supply station;

a controllable valve having a valve inlet and a valve outlet, the valve inlet is in fluid communication with the replaceable ink supply;

an accumulator having a gauge pressure less than zero and in fluid communication with the valve outlet and the printhead;

a sensor coupled to the accumulator to sense the pressure within the accumulator; and a controller electrically coupled to the sensor and electrically coupled to the controllable valve to open and close the valve in response to the pressure within the accumulator.

7. The ink delivery system of claim 6, wherein the specified pressure range is a gauge pressure range of zero to minus ten inches of water.

8. The ink delivery system of claim 6, wherein the accumulator includes a compliant member having a reference surface and a ink surface, the reference surface is in fluid communication with an outside atmosphere, the ink surface is in fluid communication with the outlet port, the compliant member is biased toward the outside atmosphere by a spring force that maintains the inside of the accumulator at a negative gauge pressure.

9. The ink delivery system of claim 6, wherein the controller has a threshold pressure set point, the accumulator has an ink pressure.

10. The ink delivery system of claim 9, wherein the controller has a debounce time, the valve is opened only when the ink pressure remains below the threshold pressure set point for a time exceeding the debounce time.

11. The ink delivery system of claim 6, wherein the controller has an open time, the open time controls the amount of ink that the controller allows into the accumulator between opening and closing.

12. The ink delivery system of claim 9, wherein the controller has an out of ink time, the valve actuator sends a signal to the printer if the ink pressure falls below the threshold pressure set point for a time exceeding the out of ink time.

13. The ink delivery system of claim 6, wherein the controller receives a signal from the printer indicative of a pressure range, the controller responds by opening and closing the valve to match the preprogrammed pressure range.

14. The ink delivery system of claim 6, wherein the controller sends a signal to the printer that is indicative of the actual pressure in the accumulator, the printer can respond increasing or decreasing the rate of printing so that accumulator pressure will stay within a specified range.

15. The ink delivery system of claim 6, wherein the controller sends a signal to the printer to slow down an ink usage rate whenever the pressure begins to fall outside a range that can be accommodated by opening the valve.

16. An ink delivery subsystem for an ink jet printing system having a printhead mounted to a scanning carriage for ejecting droplets of ink, the printhead receiving ink at a controlled pressure, the controlled pressure having a specified pressure range that assures stable printhead operation, the ink delivery subsystem comprising:

an ink supply adapted to be releasably mounted to an ink station;

a first interface on the ink supply for engagement with a second interface in the ink station to allow ink to be transferred from the ink supply to a first fluid conduit that is coupled to the ink station;

a mounting device on said ink supply for mounting the supply in a stationary position in the ink station; and ink that flows out of ink supply, through the first conduit, and to the inlet of an electromechanical valve having a valve outlet that is in fluid communication with an accumulator and the printhead, the accumulator has a regulated pressure that is lower than a supply pressure in the ink supply, a sensor is coupled to the accumulator to sense the pressure within the accumulator, a controller is coupled to the sensor and to the valve to trigger the valve, the valve opens and closes to balance usage of ink by the printhead and delivery of ink by the ink supply, the accumulator pressure is thereby maintained in a range between zero and minus ten inches of water when the ink supply is releasably mounted to the ink station.

17. The ink delivery system of claim 16, wherein the sensor is mechanically coupled to the accumulator to sense the volume of the accumulator.

18. The ink delivery system of claim 16, wherein the sensor is fluidically coupled to the accumulator and the printhead to provide a reading indicative of the pressure at the printhead.

19. The ink delivery system of claim 18, wherein the sensor is adjacent to the printhead to sense the pressure of the printhead.

20. The ink delivery system of claim 18, wherein the sensor is adjacent to the accumulator to sense the pressure of the accumulator.

21. The ink delivery system of claim 16, wherein the accumulator includes a compliant member having a reference surface and a ink surface, the reference surface is in fluid communication with an outside atmosphere, the ink surface is in fluid communication with the outlet port, the compliant member is biased toward the outside atmosphere by a spring force that maintains the inside of the accumulator at a negative gauge pressure.

22. The ink delivery system of claim 16, wherein the controller has a threshold pressure set point and the accumulator has an ink pressure.

23. The ink delivery system of claim 22, wherein the controller has a debounce time, the valve is triggered only when the ink pressure remains below the threshold pressure set point for a time exceeding the debounce time.

24. The ink delivery system of claim 16 wherein the controller has an open time, the valve remains open for the open time when the valve is triggered to open, the valve closes at the end of the open time.

25. The ink delivery system of claim 22, wherein the controller has an out of ink time, the valve actuator sends a signal to the printer if the ink pressure falls below the threshold pressure set point for a time exceeding the out of ink time.

26. The ink delivery system of claim 16, wherein the controller receives a signal from the printer indicative of a pressure range, the valve actuator responds by opening and closing the valve to match the preprogrammed pressure range.

27. The ink delivery system of claim 16, wherein the controller sends a signal to the printer that is indicative of the actual pressure in the accumulator, the printer can respond increasing or decreasing the rate of printing so that accumulator pressure will stay within a specified range.

28. The ink delivery system of claim 16, wherein the controller sends a signal to the printer to slow down an ink usage rate whenever the pressure begins to fall outside a range that can be accommodated by opening the valve.

29. A method for controlling fluid pressure in an ink delivery system having a printhead for ejecting droplets of ink, the printhead receiving ink at a controlled pressure, the controlled pressure having a specified pressure range that assures stable printhead operation, comprising the steps of:

providing a replaceable ink supply and a controllable valve having a valve inlet and a valve outlet, the valve inlet is in fluid communication with the replaceable ink supply and an accumulator that is in fluid communication with the valve outlet and the printhead;

sensing fluid pressure in said accumulator;

providing a signal indicative of said fluid pressure in said accumulator;

comparing said signal indicative of fluid pressure in said accumulator to a threshold pressure; and adjusting said controllable valve to selectively change the fluid pressure in said accumulator by using a controller electrically coupled to the controllable valve to open and close the valve in response to the result of said comparing step and a debounce time so that the controllable valve is opened only when the ink pressure remains below the threshold pressure set point for a time exceeding the debounce time.

* * * * *